United States Patent [19]

Edelhoff

[11] Patent Number: 4,844,682

[45] Date of Patent: Jul. 4, 1989

[54] GARBAGE-COLLECTING TRUCK

[75] Inventor: Gustav D. Edelhoff, Iserlohn, Fed. Rep. of Germany

[73] Assignee: Edelhoff Polytechnik, GmbH. & Co., Iserlohn, Fed. Rep. of Germany

[21] Appl. No.: 45,426

[22] Filed: May 4, 1987

[30] Foreign Application Priority Data

May 6, 1986 [DE] Fed. Rep. of Germany ..... 3615353
Sep. 19, 1986 [DE] Fed. Rep. of Germany ..... 3631914

[51] Int. Cl.[4] ..... B65F 3/04
[52] U.S. Cl. ..... 414/408; 414/742
[58] Field of Search ..... 414/406–409, 414/665–671, 681, 728, 742

[56] References Cited

U.S. PATENT DOCUMENTS

| | | | |
|---|---|---|---|
| 2,592,324 | 4/1952 | Oliver | 414/409 |
| 3,016,157 | 1/1962 | Brisson | 414/408 |
| 3,458,071 | 7/1969 | Smith | 414/408 X |
| 3,894,642 | 7/1975 | Shive | 414/406 X |
| 4,580,940 | 4/1986 | Sheaves | 414/406 |

FOREIGN PATENT DOCUMENTS

| | | | |
|---|---|---|---|
| 163859 | 12/1985 | European Pat. Off. | 414/408 |
| 644432 | 5/1937 | Fed. Rep. of Germany | 414/407 |
| 516500 | 2/1955 | Italy | 414/406 |

*Primary Examiner*—David A. Bucci
*Attorney, Agent, or Firm*—Morgan & Finnegan

[57] ABSTRACT

Garbage-collecting truck comprising a dumping unit, including a pour-in opening and lifting and tipping mechanism for receiving a garbage can and emptying it into the pour-in opening leading into a receiving chamber. The lifting and tipping mechanism comprises a lifting arm pivoted on a transverse axis to the dumping unit or truck chassis and carries a base team at its free end parallel to the transverse axis and pivotally movable between a receiving position in front of the driver's cab and a pouring position behind it. A carrier mounted on the base beam is extensible from one end of the rail by a fluid-operable piston-cylinder unit. A swivel arm mounted on the carrier is pivotally movable through links and a fluid operable piston-cylinder unit between a position in which it extends along the carrier, and an outer position, in which it extends approximately at right angles thereto. A coupling member carried by the swivel arm at its free end is adapted to be coupled to or grip a garbage can. A link or lever pivoted to the leading portion of the carrier and provided at its free end with a slider or roller running in a cam track is fixed to the base beam. A motion-transmitting bar connected to the link or lever and directly or indirectly linked to the swivel arm imparts to the swivel arm a pivotal movement in unison with like movement of the link or lever.

5 Claims, 4 Drawing Sheets

GARBAGE-COLLECTING TRUCK

BACKGROUND OF THE INVENTION

1. Field of the Invention

This invention relates to a garbage-collecting truck comprising a dumping unit, which includes a pour-in opening in the front portion of the truck and a lifting and tipping mechanisms for receiving a garbage can and for emptying the garbage can into the pour-in opening leading into a receiving chamber, wherein the lifting and tipping mechanisms comprises at least one lifting arm, which is pivoted on a transverse axis to the dumping unit or to the chassis of the truck and at its free end carries a base beam, which is parallel to the transverse axis and is pivotally movable between a receiving position in front of the driver's cab and a pouring position behind the driver's cab, a carrier, which is mounted on the base beam to be extensible from at least one end of the base beam by means of a fluid-operable piston-cylinder unit, a swivel arm, which is mounted on the carrier and which arm, by means of links and a fluid-operable piston-cylinder unit, is pivotally movable between a position in which it extends along the carrier, and an outer position, in which it extends approximately at right angles to the carrier, and a coupling member, which is carried by the swivel arm at its free end and is adapted to be coupled to and/or grip a garbage can. 2. Description of the Prior Art In a garbage-collecting truck of the kind which is known from European Patent Publication No. 163,859 (U.S. Pat. No. 4,715,767 of Dec. 27, 1987) the swivel arm, an auxiliary link, which is pivoted to the carrier at a distance from the swivel arm, and a coupling link, which constitutes the coupling member and is pivoted to the free ends of the swivel arm and the auxiliary link, constitute a four-bar linkage, which is adapted to be swung in and out by a hydraulic piston-cylinder unit, which is pivoted at one end to the carrier and at the other end to the pivoted arm. By means of an additional fluid-operable piston cylinder unit the carrier can be displaced along to the base beam, on which the carrier is slidably mounted. Owing to the provision of the four-bar linkage for pivotally moving the coupling member relative to the carrier, and of the two fluid-operable piston cylinder units, which respectively serve to pivotally move the coupling member and to displace the carrier, the kinematic arrangement and the structure of the known means for displacing and pivotally moving the coupling member is relatively complicated and expensive.

SUMMARY OF THE INVENTION

It is an object of the invention to provide for the displacement and pivotal movement of the coupling member a mechanism which is simpler than the known one.

In a garbage-collecting truck of the kind described first hereinbefore that object is accomplished in accordance with the invention by providing a link or lever which is pivoted to that portion of the carrier which is the leading portion as the carrier is extended, the link or lever carrying at its free end a slider or a roller which runs in a cam track fixed to the base beam, and a motion-transmitting bar connected to the link or lever and directly or indirectly linked to the swivel arm and adapted to impart to the swivel arm a pivotal movement in unison with a pivotal movement of the link or lever.

In a preferred embodiment, a coupling bar is pivoted to the link at a distance from its pivotal axis so that a toggle joint is provided, and the other end of the coupling bar is pivoted to the swivel arm at a distance from its pivotal connection to the carrier. In such a case the swivel arm carrying the coupling member is pivotally moved in dependence on the link which carries the roller and which is connected to the swivel arm by a coupling bar in the manner of a toggle joint. For this reason, the garbage-collecting truck in accordance with the invention need not be provided with a separate hydraulic cylinder for pivotally moving the swivel arm which carries the coupling member, it being sufficient to provide a hydraulic cylinder for displacing the carrier as the pivoted movement of the swivel arm is derived from the displacement of the carrier.

The coupling member suitably consists of a triangular gripping claw which cooperates with a wedgeshaped or spherically curved receiving pocket and a garbage can be gripped and which is adapted to center the latter, the coupling member being preferably rigidly connected to the swivel arm. Since the holding claw has a substantially planar front face, a garbage can to be gripped will be aligned with that front face in contact with the latter in conjunction with a slight displacement as the swivel arm is pivotally moved.

In a preferred embodiment a guide rod is mounted on the carrier at a distance from the pivotal axis of the link, the guide rod extending through a bore in a slide plate secured to the swivel arm. An abutment plate is provided in the range of the pivotal movement of the slide plate and a helical compression spring is compressed between the abutment plate and the slide plate, and the guide rod is mounted on the carrier in such a manner that the compression spring will be increasingly compressed as the swivel arm approaches the end of its inward pivotal movement. The compression spring constitutes a damping element and prevents the swivel arm from being struck under an excessive momentum on force in its inner end position by the hydraulic cylinder used for displacing the carrier.

In a preferred embodiment the carrier consists of two telescopically interfitted, profiled carrier sections and two parallel hydraulic piston cylinder units which are disposed on the inner carrier section, both cylinders of the cylinder-piston units being connected to an end plate on the outer carrier section, and the piston rods thereof being respectively connected, to the base beam and to an end plate on the inner carrier section. In such case, two small hydraulic cylinders can be used to effect a large outward displacement of the inner carrier section, which carries the swivel arm, relative to the base beam.

Also in a preferred embodiment, the lever consists of the crank of a crankshaft, which is rotatably mounted in the carrier, the lever being nonrotatably connected to the crankshaft and having a free end that is pivoted to a coupling bar at one end thereof, the other end of the coupling bar being pivoted to the swivel arm at a distance from its pivotal connection to the carrier.

DETAILED DESCRIPTION OF THE PREFERRED EMBODIMENTS

Figure 1:
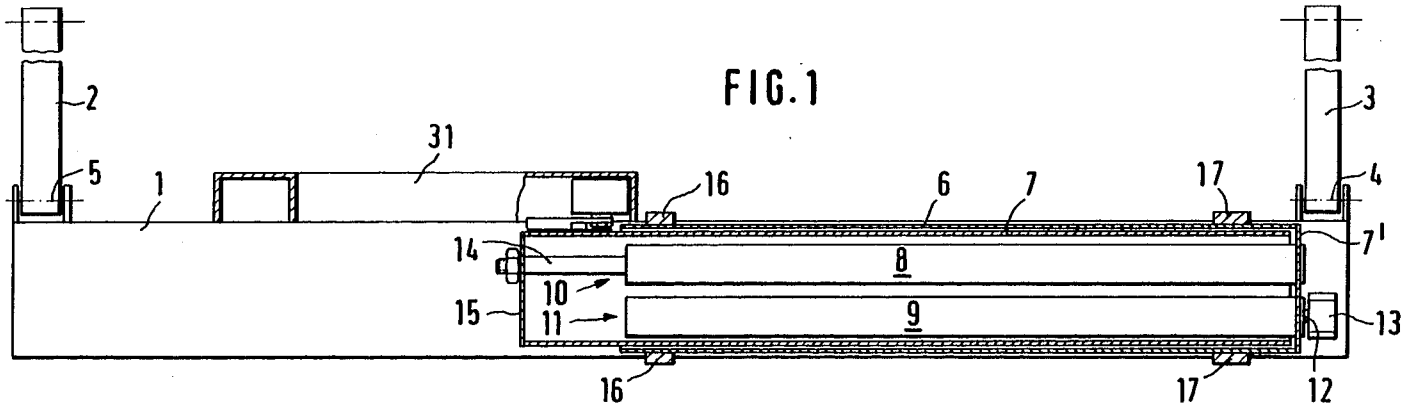
FIG. 1 is a front view in elevation and partially in section showing the pick-up device of the lifting and tipping mechanism of a garbage truck in accordance with the invention.

Two illustrating embodiments of the invention will now be explained in more detail with reference to the drawing.

In the first embodiment shown in FIGS. 1 to 5 the garbage-collecting truck comprises lifting arms 2, 3, which are disposed on both sides of the driver's cab, not shown, and are pivotally movable in vertical planes. A base beam 1 is pivoted to the forward ends of the lifting arms 2, 3 on axially aligned pivots 4, 5, which are parallel to the longitudinal direction of the base beam 1. In the manner that is known from European Patent Publication No. 163,859 the base beam 1 is pivoted to an auxiliary linkage for pivotally moving the base beam to a position which depends on the angular position of the lifting arms 2, 3.

The base beam 1 is provided with tracks, not shown, in which a carrier section 6 having in crosssection the shape of a rectangular box, is guided along the base beam. A carrier section 7 is telescoped in the carrier section 6 and has in cross-section the shape of a correspondingly smaller box. At its right-hand end, as shown in FIG. 1, the outer carrier section 6 is closed by an end plate 7'.

Cylinders 8 and 9 of the respective hydraulic piston-cylinder units 10 and 11 are secured to the end plate 7' and extend into the cavity of the inner carrier section 7. The lower cylinder 9 is secured at its rod end to the end plate 7' and its piston rod 12 extends through the end plate 7' and is secured to the abutment 13, which is fixed to the base beam 1. That end of the upper cylinder 8 which is opposite to its piston rod 14 is secured to the end plate 7'. The forward end of the piston rod 14 is secured to an end plate 15, which closes the inner carrier section 7 at its forward end.

The guidance of the outer carrier section 6 in and above the base beam 1 along the latter is effected by diagrammatically illustrated arms 16 and 7, which are secured to the outer carrier section 6 and carry guide rollers 18 and 19, which roll on the rear side of the base beam 1.

A link 21 is pivoted on a vertical axis 20 to the carrier section 7 near its forward end and at its free end carries a freely rotatably mounted roller 22. A swivel arm 25 is pivoted to the forward end portion of the inner carrier section 7 on a vertical axis 24, which is spaced from the pivotal axis 20. A coupling bar 27 is pivoted at one end to the outer end portion of the link 21 on an axis 26. The other end of the coupling bar 27 is pivoted on axis 28 to the swivel arm 25, which at its outer end carries an approximately triangular pick-up claw 30.

Figure 2:
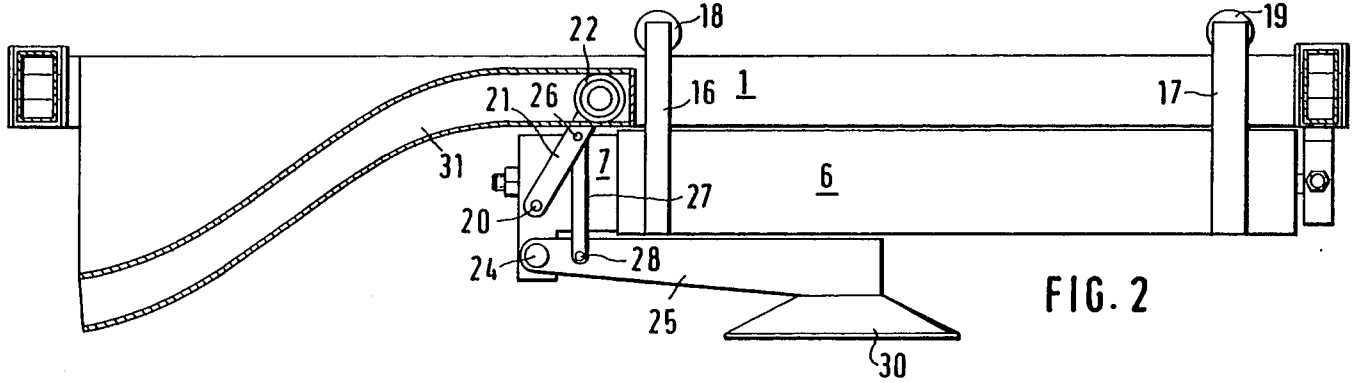
FIG. 2 is a top plan view showing the pick-up device of FIG. 1.

The roller 22 mounted at the free end of the link 21 runs in a channel-shaped cam track 31, which is secured to the base beam 1. When the piston-cylinder units 10 and 11 displace the carrier sections 6 and 7 to the left in FIGS. 1 and 2, the link 21 and the coupling bar 27 impart to the swivel arm 25 a pivotal movement in the clockwise sense in FIG. 2 until the swivel arm 25 is approximately at right angles to the carrier sections 6 and 7. In FIGS. 1 and 2 the swivel arm 25 is shown in its swung-in position, in which the pick-up claw 30 is disposed midway between the lifting arms 2 and 3. In swung-out position, not shown, of the swivel arm 25 that portion of the inner carrier section 7 which carries the pivots 20 and 21 is extended to the left in FIG. 2 to a position over the lifting arm 2.

The locations of the pivotal axes 20, 24, 26 and 28 of the link 21, the swivel arm 25 and the coupling bar 27 and the curvature of the cam track 31 are selected so that the desired outward pivotal movement will be imparted to the swivel arm 25 as the carrier section 6 and 7 are extended.

Figure 3:
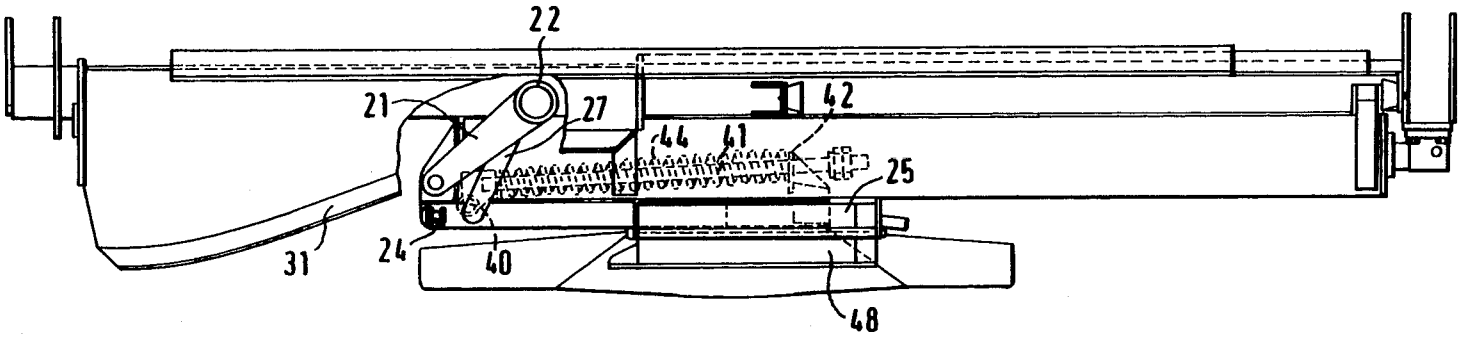
FIG. 3 is a top plan view that is similar to FIG. 2 showing the pick-up device and associated damping means.
Figure 4:
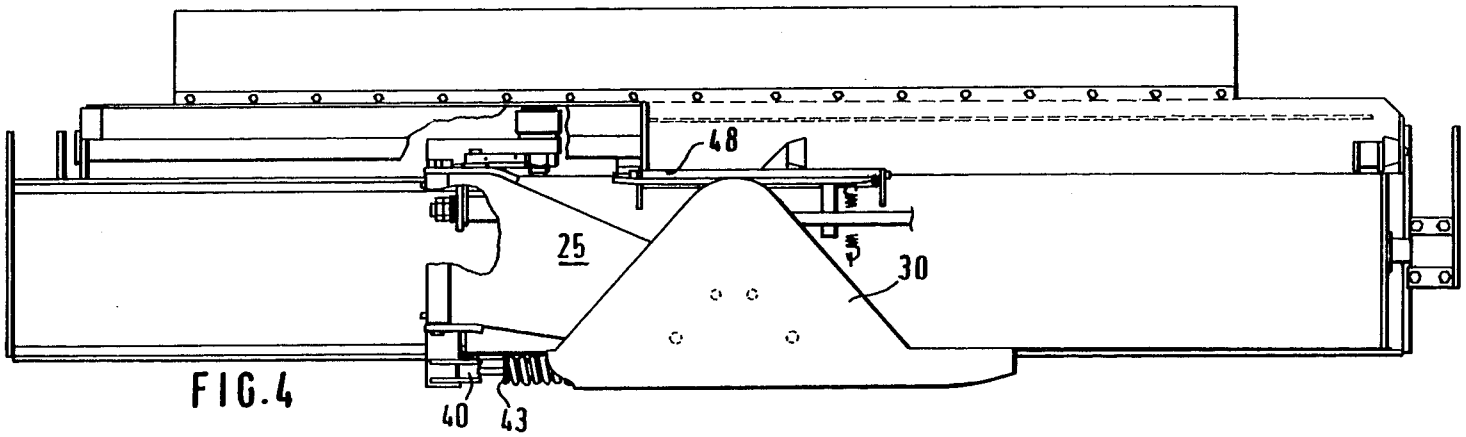
FIG. 4 is a front view in elevation of the pick-up device of FIG. 3.
Figure 5:
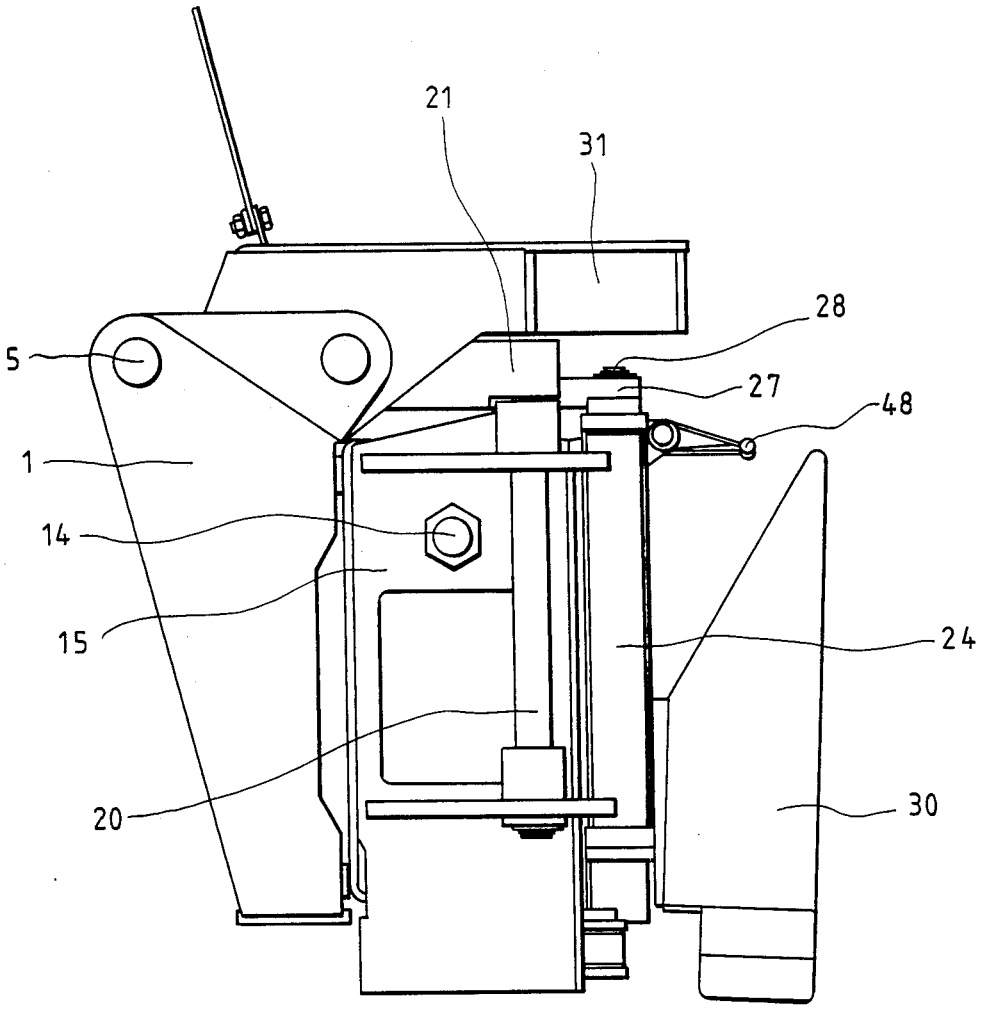
FIG. 5 is a side view in elevation showing the pick-up device of FIGS. 3 and 4.

As is shown in FIG. 3 a rod 41 is pivoted on axis 40 to the left-hand end portion (as viewed in FIG. 3) of the inner carrier section 7. The rod 41 slidably extends through a bore in a slide plate 42, which is fixedly secured to the forward end portion of the swivel arm 25. The rear end of the rod 41 is connected to an abutment plate 43. A helical compression spring 44 is compressed between the abutment plate 43 and the slide plate 42. The locations of the pivotal axis 40 of the rod 41 and of the bore of the slide plate 42 are so selected that the spring 44 will be increasingly compressed as the swivel arm 25 is swung to its inner end position. As a result, the spring exerts a damping action on the piston-cylinder units so that the swivel arm will not be struck at a high rate of kinetic energy to its inner end position.

When the cans have been coupled to the pick-up claw 30, they are locked in position as they are lifted and tipped. That locking is effected by a backing plate 48, which is secured to the swivel arm 25 and disposed at the top of the pick-up claw 30 when it has been swung to its inner end position. The backing plate engages the top of the top edge portion of the garbage can as it is emptied. The backing plate is mounted to be pivotally movable against a spring force through a small angle between end position which are defined by stop abutments.

Figure 8:
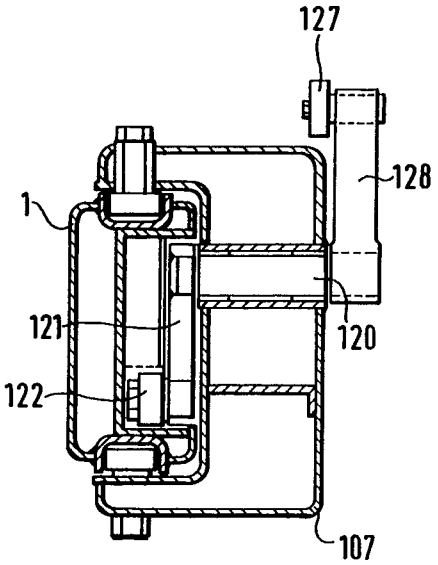
FIG. 8 is a transverse sectional view taken on line a-b of FIG. 6 viewed in the direction of the arrows.
Figure 6:
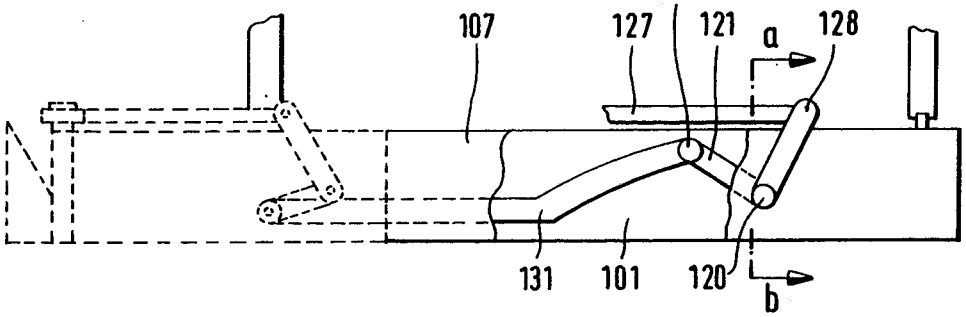
FIG. 6 is a front view in elevation showing another embodiment of the means for controlling the swivel arm.
Figure 7:
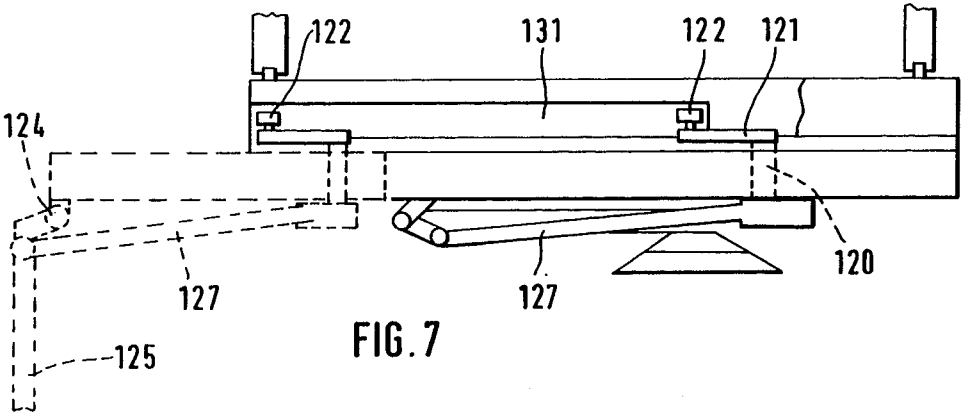
FIG. 7 is a top plan view showing the control means of FIG. 6.

Another embodiment of the means for controlling the swivel arm identified by numeral 125 will now be described with reference to FIGS. 6 to 8.

In that embodiment the base beam identified by numeral 101 is provided in its forward side face with a cam track 131, which consists of a groove. A roller 122 is rotatably mounted at the free end of a lever 121 and rolls in groove 131. Lever 121 constitutes a crank, which is secured to the inner end of a crank-shaft 120, which is rotatably mounted in the telescopically extensible carrier section 107. The outer end of the crankshaft 120 protrudes from the telescopically extensible carrier section 107. A lever 128 is non-rotatably connected to that outer end of the crankshaft 120 and has a free end that is pivoted to one end of a coupling bar 127. The other end of the coupling bar 127 is coupled to the swivel arm 125 at a distance from the pivotal axis 124 on which the swivel arm 125 is pivoted to the telescopically extensible carrier section 107. In that arrangement an extension of the carrier 107 will cause the crank to impart to the coupling bar 127 a movement which causes the swivel arm 125 to perform an outward and inward pivotal motion between the end positions of the cam follower roller 122 moving in the cam track 131.

I claim:

1. In a lifting and tipping mechanism for a garbage truck for receiving a garbage can and for emptying contents of said garbage can into said garbage truck, said lifting and tipping mechanism comprising at least one lifting arm pivoted on a transverse axis and carrying a base beam at a free end, the base beam being parallel to said transverse axis and pivotally movable between a receiving position and a pour position, a carrier mounted on said base beam extensible from at least one end of said base beam by means of a fluid-operable piston-cylinder unit, a swivel arm mounted on said carrier pivotally movable between a position in which it extends along said carrier and an outer position in which it extends approximately at right angles to said carrier, a coupling member carried by said swivel arm at its free end and adapted to be coupled to and grip said garbage can, and a link or lever pivoted at a pivotal axis to a portion of said carrier which is a leading portion as said carrier is extended, said link or lever carrying at its free end a slider or a roller running in a cam track fixed to said base beam, and a motion-transmitting bar means connected to said link or lever and to said swivel arm for imparting to said swivel arm a pivotal movement in unison with pivotal movement of said link or lever.

2. A lifting and tipping mechanism according to claim 1, wherein the motion-transmitting bar means is pivoted to the link or lever at one of its ends at a distance from the pivotal axis of the link or lever and which motion-transmitting bar means provides a toggle joint, the other end of said motion-transmitting bar means being pivoted to the swivel arm at a distance from the pivotal connection of the swivel arm to the carrier.

3. A lifting and tipping mechanism according to claim 1, wherein a guide rod is mounted on the carrier at a distance from the pivotal axis to the link or lever, said guide rod extending through a bore in a slide plate secured to the swivel arm and abutting on an abutment plate provided in a range of pivotal movement of said slide plate, a helical compression spring disposed around said guide rod and compressed between said abutment plate and said slide plate, said guide rod being mounted on said carrier so that said compression spring will be increasingly compressed as said swivel arm is pivoted to an inner end position.

4. A lifting and tipping mechanism according to claim 1, wherein the carrier comprises inner and outer telescopically interfitted, profiled carrier sections provided with end plates and two parallel hydraulic piston-cylinder units which are connected to an end plate of the outer carrier section, an piston rods of said piston cylinder units being respectively connected to the base beam and to an end plate of the inner carrier section.

5. A lifting and tipping mechanism according to claim 2, wherein the link or lever includes a crankshaft which is rotatably mounted in the carrier, another lever non-rotatably connected to one of its ends to said crankshaft and the other end of said another beam pivoted to one end of the motion-transmitting bar means.

* * * * *